US010087658B2

(12) United States Patent
Gresham, IV et al.

(10) Patent No.: US 10,087,658 B2
(45) Date of Patent: Oct. 2, 2018

(54) REFRIGERATOR DOOR-IN-DOOR LATCH

(71) Applicant: WHIRLPOOL CORPORATION, Benton Harbor, MI (US)

(72) Inventors: Joseph Gresham, IV, St. Joseph, MI (US); Evan W. Kessick, Niles, MI (US); Ryan M Post, Coloma, MI (US); Daniel Quinlan, Stevensville, MI (US); Rahul Wadke, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 341 days.

(21) Appl. No.: 14/978,199

(22) Filed: Dec. 22, 2015

(65) Prior Publication Data

US 2017/0175423 A1 Jun. 22, 2017

(51) Int. Cl.

| | |
|---|---|
| ***F25D 23/00*** | (2006.01) |
| ***E05B 65/00*** | (2006.01) |
| ***E05C 3/30*** | (2006.01) |
| ***F25D 23/02*** | (2006.01) |
| ***F25D 23/04*** | (2006.01) |
| ***F25D 23/06*** | (2006.01) |
| ***F25D 25/02*** | (2006.01) |

(52) U.S. Cl.

CPC ..... *E05B 65/0042* (2013.01); *E05C 3/30* (2013.01); *F25D 23/025* (2013.01); *F25D 23/028* (2013.01); *F25D 23/04* (2013.01); *F25D 23/066* (2013.01); *F25D 25/025* (2013.01); *E05Y 2900/31* (2013.01); *F25D 2323/023* (2013.01); *F25D 2325/021* (2013.01)

(58) Field of Classification Search

CPC ..... F25D 23/025; F25D 23/028; F25D 2323/023; E05B 65/0042; E05B 3/30

See application file for complete search history.

(56) References Cited

U.S. PATENT DOCUMENTS

| | | | |
|---|---|---|---|
| 6,296,285 | B1 | 10/2001 | Alvring et al. |
| 7,318,633 | B2 | 1/2008 | Shin et al. |
| 8,104,800 | B2 | 1/2012 | Lorek |
| 8,752,918 | B2 | 6/2014 | Kang |

(Continued)

FOREIGN PATENT DOCUMENTS

| | | |
|---|---|---|
| JP | S5084862 | 7/1975 |
| JP | S5785184 | 5/1982 |

*Primary Examiner* — Daniel J Rohrhoff

(74) *Attorney, Agent, or Firm* — Diederiks & Whitelaw, PLC

(57) ABSTRACT

A door-in-door refrigerator includes a door having an inner door and an outer door. When the inner and outer doors are in open positions, food items stored in a main refrigerated compartment are accessible. When the inner and outer doors are in closed positions, the door seals the refrigerated compartment, and food items stored in the main refrigerated compartment are not accessible. When the inner door is in a closed position and the outer door is in an open position, food items stored in a storage structure coupled to the door are accessible. A latch includes a trigger that moves in a direction substantially parallel to a handle. Movement of the trigger shifts the latch between a latched position, in which pulling on the handle causes the inner and outer doors to open, and an unlatched position, in which pulling on the handle causes the outer door to open while the inner door remains closed.

20 Claims, 6 Drawing Sheets

(56) References Cited

U.S. PATENT DOCUMENTS

| | | | | |
|---|---|---|---|---|
| 8,801,124 | B2 | 8/2014 | Jung et al. | |
| 8,844,983 | B2 | 9/2014 | Kang et al. | |
| 8,857,865 | B2 | 10/2014 | Im et al. | |
| 8,857,930 | B2 | 10/2014 | Im et al. | |
| 9,267,727 | B2 * | 2/2016 | Lim | F25D 23/028 |
| 9,322,592 | B2 | 4/2016 | Kim et al. | |
| 9,410,732 | B2 * | 8/2016 | Choi | E05B 65/0042 |
| 9,482,463 | B2 * | 11/2016 | Choi | F25D 23/04 |
| 9,562,713 | B2 | 2/2017 | Lim et al. | |
| 9,574,818 | B2 | 2/2017 | Choi et al. | |
| 9,605,891 | B2 * | 3/2017 | Lee | F25D 23/02 |
| 2014/0232250 | A1 | 8/2014 | Kim et al. | |
| 2015/0069900 | A1 | 3/2015 | Lim et al. | |
| 2015/0260447 | A1 | 9/2015 | Kim et al. | |
| 2016/0138855 | A1 * | 5/2016 | Choo | E05B 47/06 312/405.1 |
| 2017/0188721 | A1 * | 7/2017 | Park | F21V 29/89 |
| 2017/0284730 | A1 * | 10/2017 | Yoo | F25D 25/025 |

* cited by examiner

REFRIGERATOR DOOR-IN-DOOR LATCH

BACKGROUND OF THE INVENTION

The present invention pertains to the art of refrigeration and, more particularly, to latches for door-in-door refrigerators.

Typically, a refrigerator has at least two exterior doors, with one door sealing a fresh food compartment and the other door sealing a freezer compartment. Such doors can be hinged so as to pivot or, alternatively, the doors can constitute a front for sliding drawers. The particular arrangement depends on the style of the refrigerator, such as a side-by-side, French door, bottom-freezer or top-mount configuration. Recently, door-in-door refrigerators have been created in which a door sealing a fresh food compartment, for example, includes both an inner door and an outer door. As a result, food or other items can be stored in a storage structure which establishes a specialty or auxiliary compartment between the inner and outer doors. Unfortunately, these known arrangements can also pose a problem for a user. Specifically, it is possible for a user to accidentally open both of the inner and outer doors simultaneously when attempting to open only the outer door.

With this in mind, there is a need in the art for a door-in-door refrigerator that enables a user to conveniently access both a specialty compartment (by opening only an outer door) and a main compartment of the refrigerator by simultaneously opening both an inner door and the outer door without accidentally accessing the other area.

SUMMARY OF THE INVENTION

The present invention is directed to a door-in-door refrigerator comprising a cabinet, a door, a storage structure establishing a specialty or auxiliary compartment, a handle and a latch. The cabinet includes a liner that defines a main refrigerated compartment, and the door is configured to selectively seal the refrigerated compartment. The door includes an inner door and an outer door. The storage structure is coupled to the door and configured to store select food items. When the inner and outer doors are in open positions, food items stored in the main refrigerated compartment are accessible. When the inner and outer doors are in closed positions, the door extends across and seals the refrigerated compartment, and food items stored in the main refrigerated compartment are not accessible. When the inner door is in a closed position and the outer door is in an open position, food items stored in the storage structure are accessible. The handle is coupled to the outer door, and the latch is configured to selectively couple the inner door to the outer door. The latch includes a trigger coupled to the outer door and configured to move in a direction substantially parallel to the handle. Movement of the trigger shifts the latch between a latched position, in which pulling on the handle enables the inner and outer doors to simultaneously open, and an unlatched position, in which pulling on the handle causes the outer door to open while the inner door remains closed. Preferably, the trigger is configured to move in a substantially vertical direction.

The handle includes a first foot coupled to the outer door and a bar coupled to the first foot. The bar is configured to be gripped by a user's hand, and the trigger is configured to move in a direction substantially parallel to the bar. In one embodiment, the handle further includes a second foot coupled to the outer door, the bar being coupled to the second foot. Preferably, the trigger is located between the first foot and the second foot and between the outer door and the bar. In another embodiment, the first foot includes an opening, and the trigger is configured to slide into or further within the opening during movement of the trigger.

The latch further includes a latching bar and a catch. The latching bar is configured to selectively contact the catch. When the latching bar contacts the catch, the latch is latched and, when the latching bar does not contact the catch, the latch is unlatched. The trigger is coupled to the latching bar, and movement of the trigger causes the latching bar to move into or out of contact with the catch. The latching bar is coupled to the outer door, and the catch is coupled to the inner door. The latch further includes a spring configured to bias the latching bar into contact with the catch.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention. Additionally, as used in connection with the present invention, terms such as "parallel", "perpendicular", "vertical" and "horizontal" do not necessarily require, for example, that the relevant items be perfectly parallel. Instead, these terms contemplate a margin of error, such as +/−5° (regardless of whether the error is by design or due to inherent manufacturing limitations) so long as the error does not prevent the present invention from functioning as intended. The modifier "substantially" increases the margin of error to +/−10°, while the modifier "generally" increases the margin to +/−15°.

Figure 1:
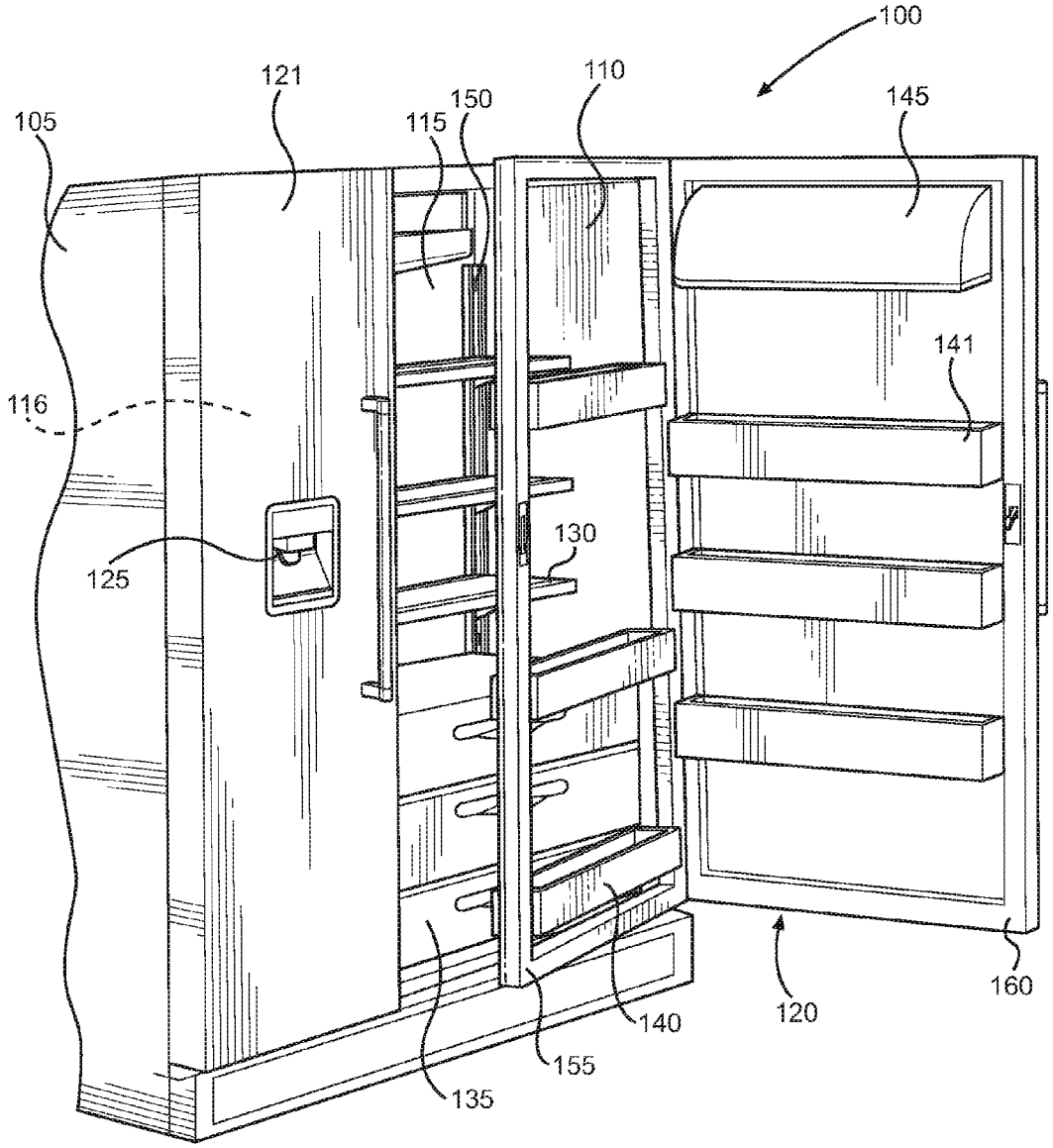
FIG. 1 is a perspective view of a refrigerator including a door-in-door arrangement in accordance with the present invention.

With initial reference to FIG. 1, there is shown a refrigerator 100 exemplifying the present invention. Refrigerator 100 is shown in a side-by-side configuration, but the invention can certainly be employed in other refrigerator configurations, e.g., French door, bottom-mount and top-mount refrigerators. Refrigerator 100 includes a cabinet (or outer shell) 105 within which is positioned a liner 110 that defines a fresh food compartment 115. Another liner (which is not visible this view) is also positioned in cabinet 105 to define a freezer compartment 116. Additionally, refrigerator 100 includes a fresh food door 120, which selectively seals fresh food compartment 115, and a freezer door 121, which selectively seals freezer compartment 116. In the embodiment shown, freezer door 121 includes a dispenser 125 for dispensing water and/or ice when desired by a user. For completeness, refrigerator 100 is also shown to include a variety of storage structures, such as a plurality of shelves (one of which is labeled 130), a plurality of drawers (one of which is labeled 135), a first plurality of door bins (one of which is labeled 140), a second plurality of door bins (one of which is labeled 141) and a dairy compartment 145. Preferably, at least the shelves and door bins are vertically adjustable, with the shelves being adjustable along a pair of ladder rails (one of which is labeled 150). Of course, other support arrangements, such as flipper shelf supports, can be used in place of the pair of ladder rails. In addition, one or more of the drawers can be temperature or climate controlled, if desired. Although not shown, refrigerator 100 further includes a cooling (or refrigeration) system that establishes above and below freezing temperatures in compartments 115 and 116, respectively, by generating and then circulating cool air within cabinet 105.

Unlike a typical refrigerator, fresh food door 120 includes an inner door 155 and an outer door 160. As a result, refrigerator 100 constitutes a door-in-door refrigerator. When outer door 160 is opened, the storage structure coupled to inner door 155 and outer door 160 (i.e., the pluralities of door bins and dairy compartment 145) is accessible by a user. When both inner door 155 and outer door 160 are opened, fresh food compartment 115 and the storage structure coupled to inner door 155 are accessible by the user. Optionally, some or all of the storage structure coupled to outer door 160 are also accessible by the user when both inner door 155 and outer door 160 are opened. Accordingly, any food items stored in these locations are accessible by the user. Although one potential storage configuration for fresh food door 120 is shown in FIG. 1, it should be recognized that a variety of configurations can be used in connection with the present invention. For instance, in addition to shifting the positions of the door bins or changing their number, the size of the opening in inner door 155 can be decreased. Furthermore, additional structure can be provided on inner door 155 to limit the amount of air that exits fresh food compartment 115 when outer door 160 is open. Regardless, as the particular storage configuration is not important to the present invention, it will not be detailed further herein.

Figure 2A:
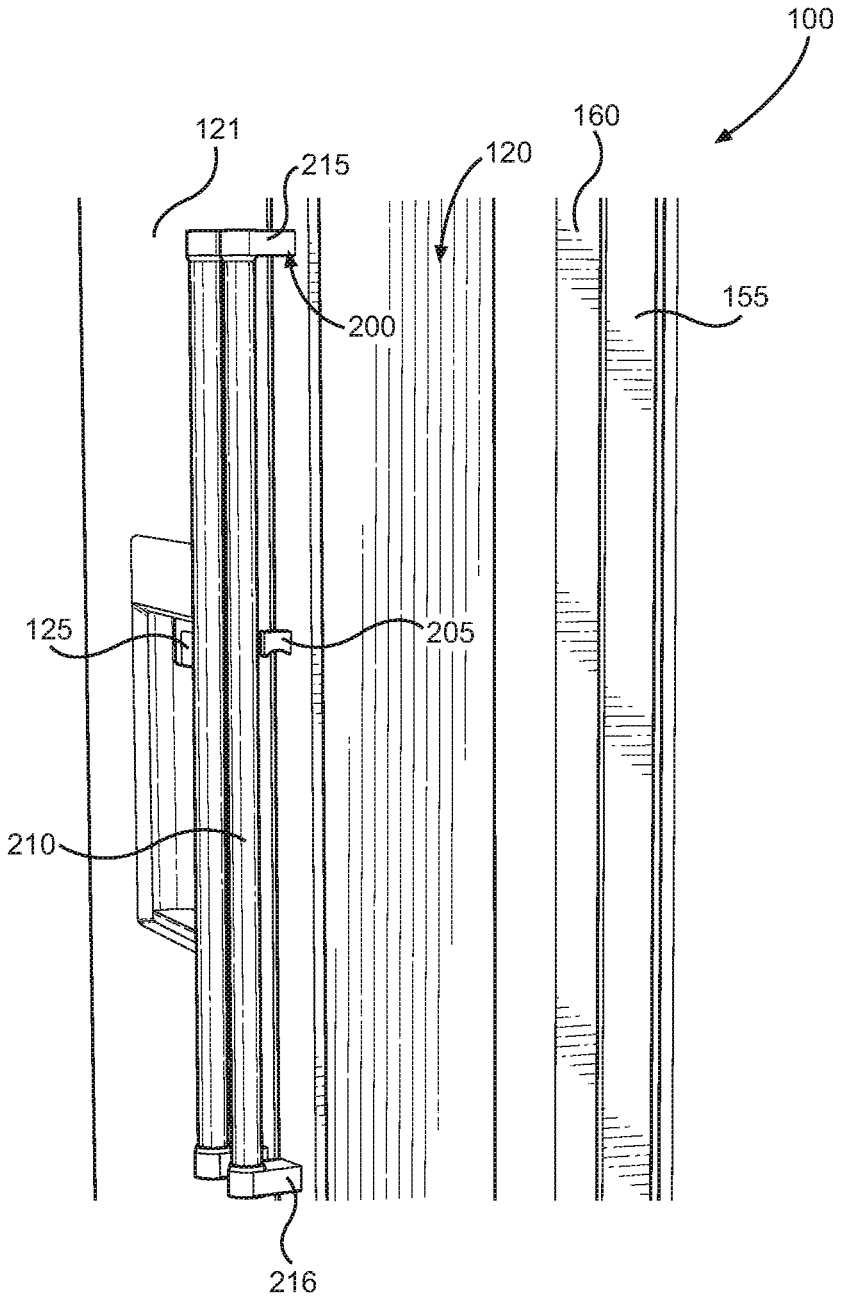
FIG. 2A is a perspective view of a refrigerator door handle in accordance with one embodiment of the present invention.
Figure 2B:
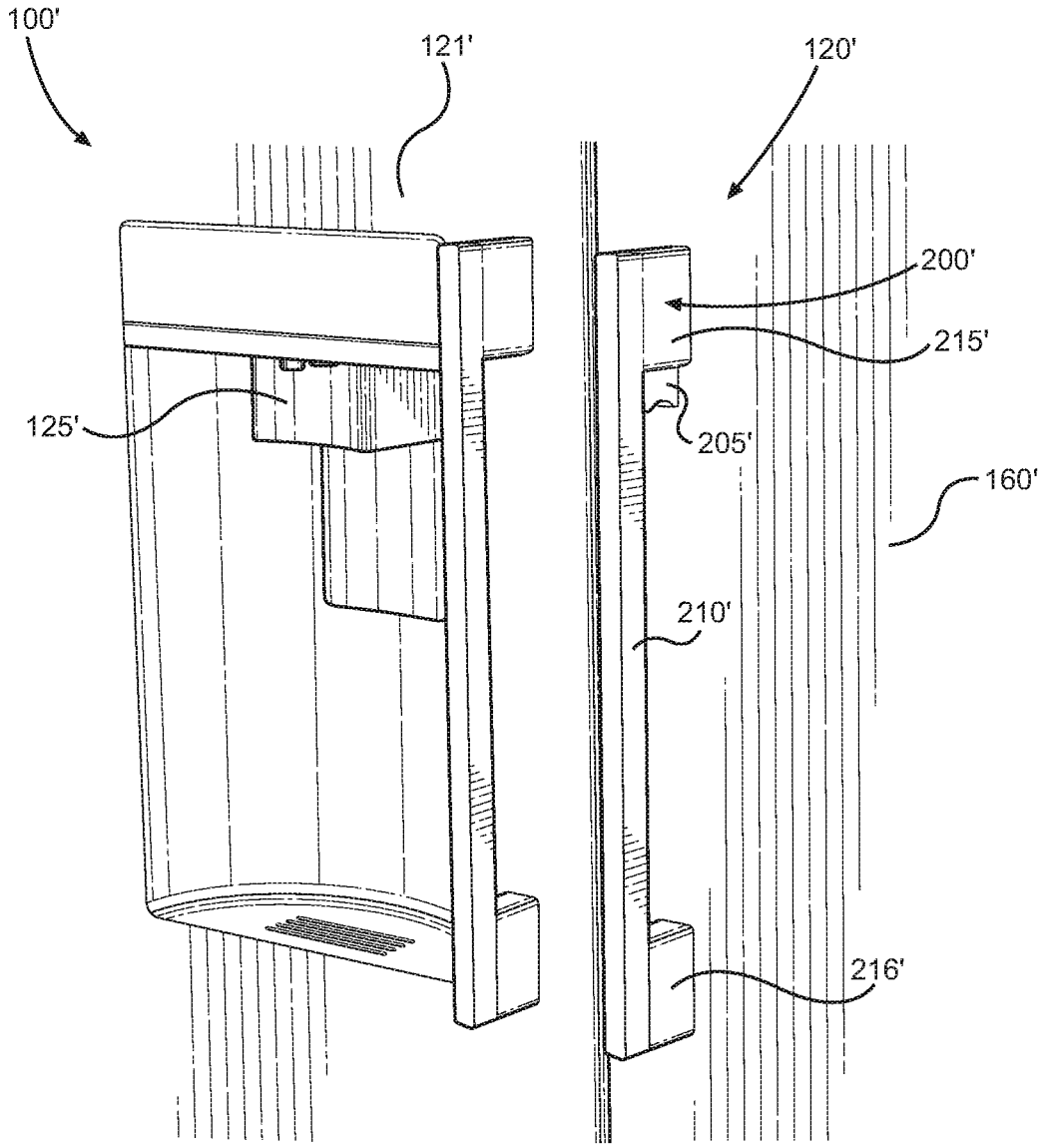
FIG. 2B is a perspective view of a refrigerator door handle in accordance with another embodiment of the present invention.

Turning to FIGS. 2A and 2B, two different handle embodiments for door-in-door refrigerators are shown. As noted above, one potential problem for a door-in-door refrigerator is the possibility of a user accidentally opening both of the inner and outer doors when attempting to open only the outer door or vice versa. To overcome this problem, a door-in-door refrigerator in accordance with the present invention provides a way for the user to indicate which of the doors should open. In particular, in FIG. 2A, refrigerator 100 includes a handle 200 and a trigger 205 coupled to outer door 160. When the user simply pulls on handle 200, inner door 155 and outer door 160 both pivot from a closed position to an open position. When the user activates trigger 205 and then pulls on handle 200, only outer door 160 pivots to an open position, while inner door 155 remains in the closed position. Activation of trigger 205 is accomplished by lifting trigger 205 upward such that trigger 205 slides in a direction substantially parallel to handle 200. More specifically, this is generally accomplished by the user wrapping his/her hand around a bar 210 of handle 200 with his/her index finger near trigger 205. Then, the user lifts his/her hand upward, and his/her index finger contacts trigger 205, which causes trigger 205 to move upward as well (in a substantially vertical direction). Of course, the user is free to activate trigger 205 in any manner the user finds convenient.

In the particular arrangement shown in FIG. 2B, a handle 200' includes a bar 210' coupled to fresh food door 120' by a first foot 215' and a second foot 216', with a trigger 205' located adjacent to first foot 215'. Bar 210' represents the portion of handle 200' that is configured to be grasped by the user, while first foot 215' and second foot 216' serve to couple bar 210' to an outer door 160'. During activation, trigger 205' slides into an opening (not visible in this perspective) formed in first foot 215'. Preferably, prior to activation, trigger 205' is located at least partially within first foot 215' such that, during activation, trigger 205' slides further within first foot 215'. In contrast, in FIG. 2A, trigger 205 is located near a center of handle 200 and does not slide into any opening formed in handle 200. Otherwise, the embodiments of FIGS. 2A and 2B function in the same manner, each having a trigger that is located between a first foot and a second foot and between an outer door and a bar.

The particular trigger arrangement (and corresponding style of trigger activation) described above are preferred because it is considered that these arrangements cannot lead to accidental triggering and will not require more effort from the user than is desirable. For example, if a trigger were integrated into the rear of bar 210 (i.e., the portion of bar 210 closest to fresh food door 120), then the user might accidentally activate the trigger simply by pulling on handle 200. As another example, if a trigger were integrated into the front of bar 210 (i.e., the portion of bar 210 furthest from fresh food door 120), then the user would have to use his/her thumb in a manner not typically required when opening fresh food door 120. Alternatively, in such an arrangement, the user would need to use another finger and then readjust his/her grip, or the user would need to use a finger from his/her other hand. Regardless of how the user chooses to activate such a trigger, this arrangement is inconvenient for the user. In contrast, triggers 205 and 205' of the present invention are less likely to be accidentally activated and do not require the use of the user's thumb or an additional finger. The user can simply grip handle 200 or handle 200' as normal and, if activating trigger 205 or trigger 205', slide his/her hand upward before pulling. With respect to the embodiment of FIG. 2A, a further advantage of this arrangement is that handle 200 and trigger 205 do not interact with one another (i.e., handle 200 and trigger 205 do not make contact with, are not coupled to and do not fit within one another). Therefore, in such an embodiment, a wide variety of handles can be used without affecting the trigger and vice versa. Also, handle 200 can readily be used in a non-door-in-door refrigerator without modification.

Figure 3:
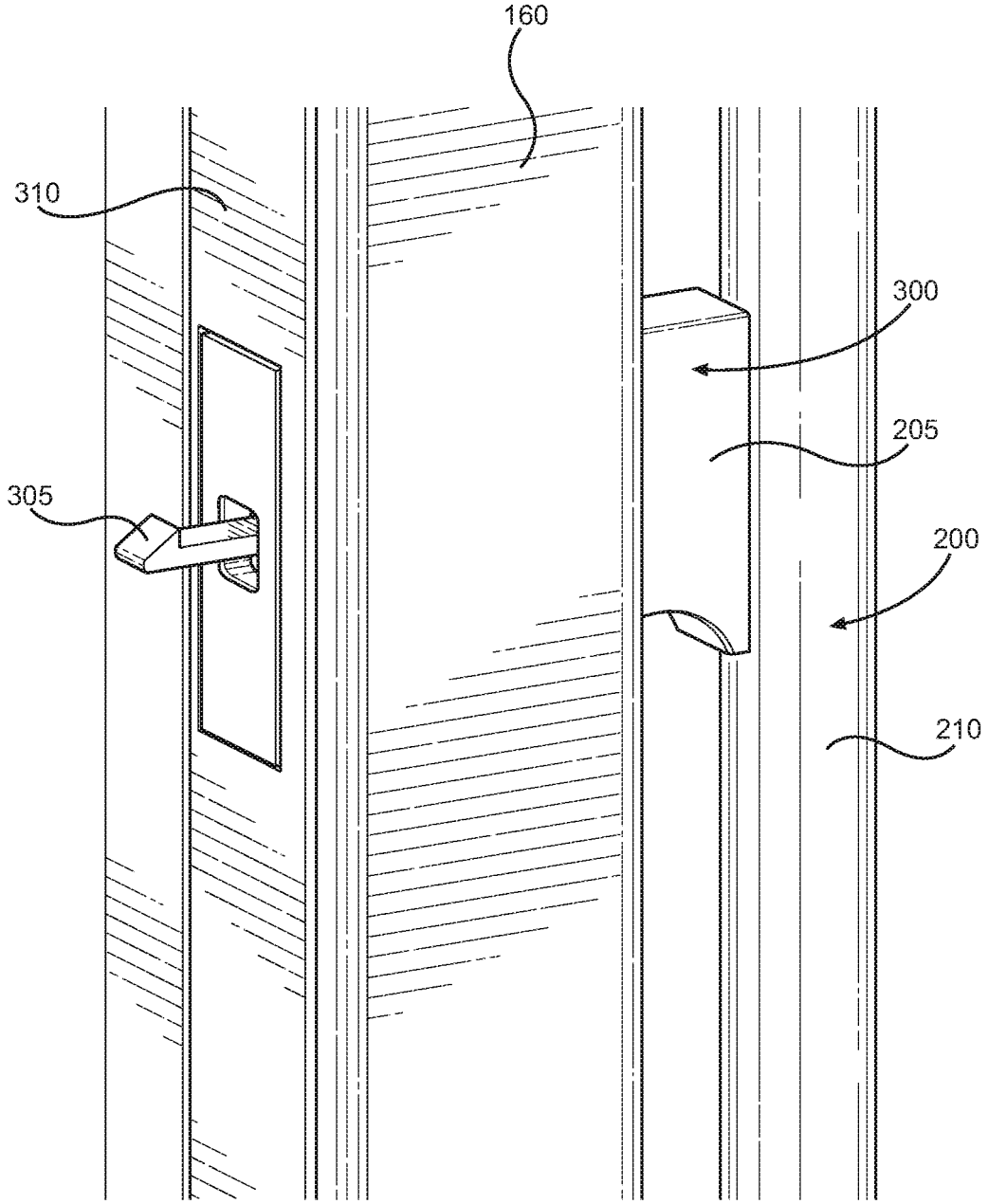
FIG. 3 is a perspective view of a portion of an outer door in accordance with the present invention.

With reference now to FIG. 3, there is shown a portion of a latch 300 in accordance with the present invention. As discussed above, trigger 205 (which is part of a latch 300) slides relative to handle 200 to allow for the selective opening of either outer door 160 or both inner door 155 and outer door 160. In FIG. 3, outer door 160 is shown in an open position, and inner door 155 is not visible. The selective opening of inner and outer doors 155 and 160 is accomplished through movement of a latching bar 305 of latch 300. In particular, as will be discussed in more detail below, movement of trigger 205 causes latching bar 305 to move so that latch 300 is shifted between a latched position, in which pulling on handle 200 causes inner door 155 and outer door 160 to open, and an unlatched position, in which pulling on handle 200 causes only outer door 160 to open. Latching bar 305 is coupled to outer door 160 and projects rearwardly from an interior face 310 of outer door 160 so as to be connectable to corresponding structure in inner door 155.

Figure 4A:
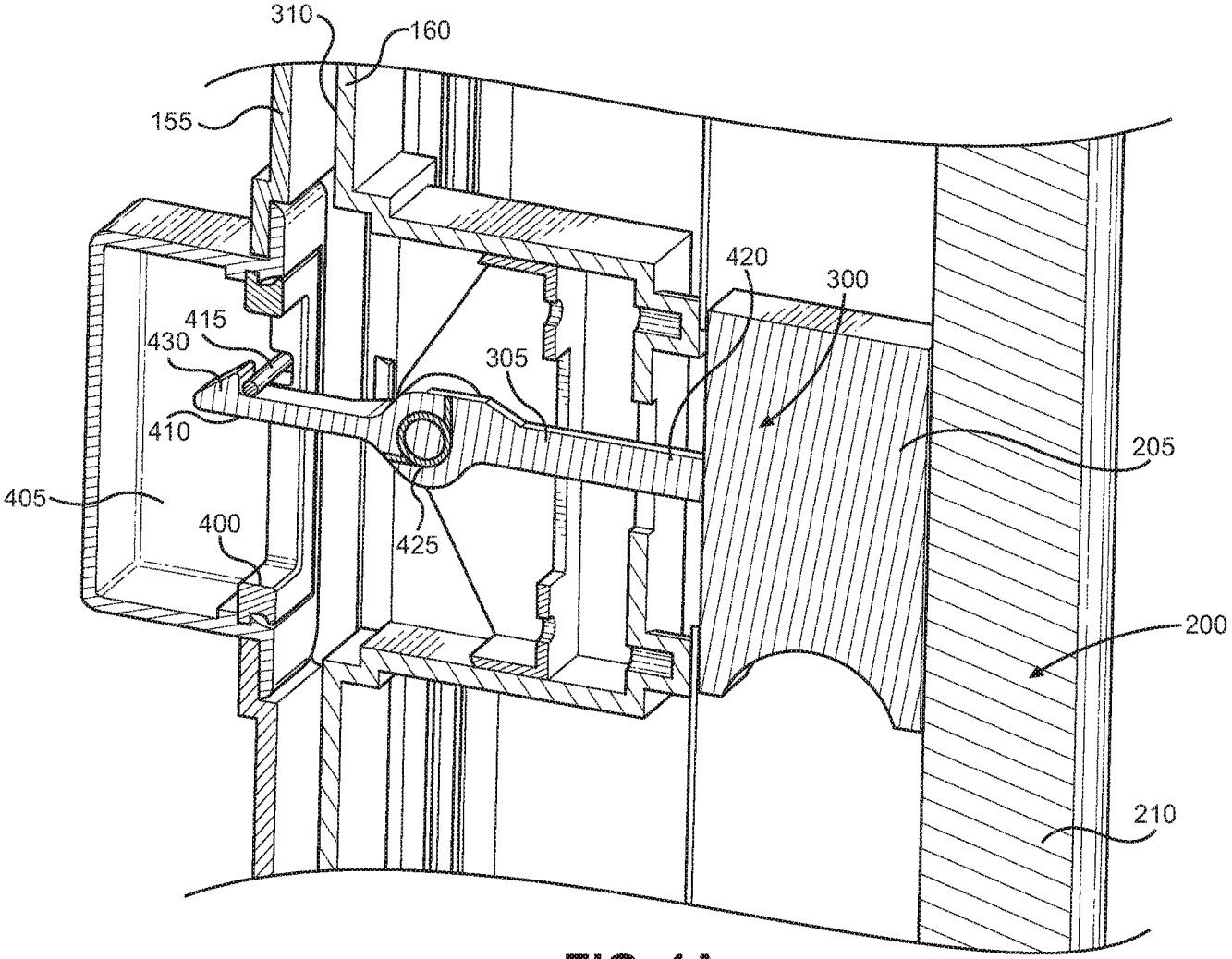
FIG. 4A is a cross-section of the outer door and an inner door in accordance with one embodiment of the present invention.

FIG. 4A shows latch 300 in cross-section in the latched position. In this position, latching bar 305 extends from outer door 160 through an opening 400 in inner door 155 to a cavity 405 where a first end 410 of latching bar 305 contacts a catch 415, which takes the form of a latching pin and is coupled to inner door 155. A second end 420 of latching bar 305 is coupled to trigger 205 so that translational movement of trigger 205 causes rotational movement of latching bar 305. A torsion spring 425 biases latching bar 305 into contact with catch 415 and, therefore, biases latch 300 to the latched position. It should be recognized though that a compression or extension spring can be used in place of torsion spring 425. When trigger 205 is shifted upward, latching bar 305 is caused to pivot in a counterclockwise direction (relative to FIG. 4) against the bias of torsion spring 425, and latching bar 305 moves out of contact with catch 415. If the user pulls on handle 200 when latch 300 is in this unlatched position, the force exerted by the user is not transmitted to inner door 155 since latching bar 305 is not in contact with catch 415. As a result, pulling on handle 200 causes only outer door 160 to open. If the user pulls on handle 200 when latch 300 is in the latched position, the force exerted by the user is transmitted from handle 200 to inner door 155 through outer door 160, latching bar 305 and catch 415. In particular, force is transmitted from latching bar 305 to catch 415 by an upturned portion 430 of first end 410 of latching bar 305. As a result, pulling on handle 200 causes both inner door 155 and outer door 160 to open.

Figure 4B:
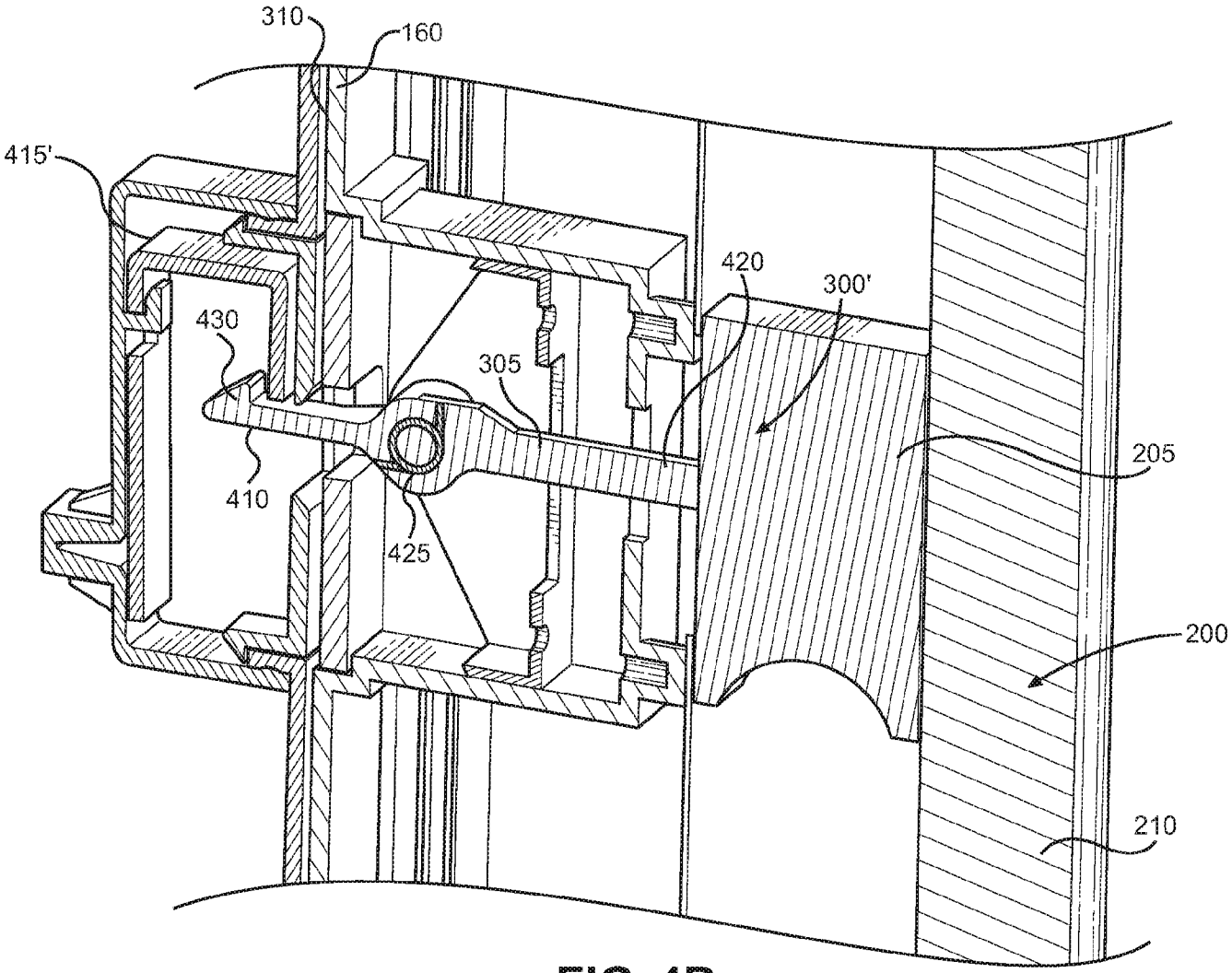
FIG. 4B is a cross-section of the outer door and an inner door in accordance with another embodiment of the present invention.

FIG. 4B shows a latch 300' in cross-section in the latched position. Latch 300' is identical to latch 300 except for the replacement of catch 415 with a catch 415'. Catch 415' serves the same function as catch 415 but takes the form of a latching bracket rather than a latching pin.

In addition to the particular structure described above and shown in FIGS. 1-4, it should be recognized that various aspects of the present invention can be modified without departing from the spirit of the present invention. For example, operation of the latch can be reversed such that, when the trigger is not activated, pulling on the door handle opens only the outer door and, when the trigger is activated, pulling on the door handle opens both the inner and outer doors. Furthermore, the latch can be used in connection with a door for a freezer compartment or with a door connected to a sliding drawer. Also, multiple latches can be included when the refrigerator has multiple pairs of inner and outer doors.

Based on the above, it should be readily apparent that the present invention provides a door-in-door refrigerator that enables a user to conveniently access both the interior of a door (by opening only an outer door) and the interior of the refrigerator (by opening both an inner door and the outer door) without accidentally accessing the other area. Although described with reference to preferred embodiments, it should be readily understood that various changes or modifications could be made to the invention without departing from the spirit thereof. For example, the handle can be re-oriented, such as horizontally, rather than vertically. In general, the invention is only intended to be limited by the scope of the following claims.

The invention claimed is:

1. A door-in-door refrigerator comprising:

a cabinet including a liner that defines a refrigerated compartment;

a door configured to selectively seal the refrigerated compartment, the door including an inner door and an outer door;

a storage structure coupled to the door, the storage structure being configured to store food items, wherein, when the inner and outer doors are in open positions, food items stored in the refrigerated compartment are accessible, when the inner and outer doors are in closed positions, the door extends across and seals the refrigerated compartment and food items stored in the refrigerated compartment are not accessible, and, when the inner door is in a closed position and the outer door is in an open position, food items stored in the storage structure are accessible;

a handle coupled to the outer door; and a latch configured to selectively couple the inner door to the outer door, the latch including a trigger coupled to the outer door and configured to move in a direction substantially parallel to the handle, wherein movement of the trigger shifts the latch between a latched position, in which pulling on the handle causes the inner and outer doors to simultaneously open, and an unlatched position, in which pulling on the handle causes the outer door to open while the inner door remains closed.

2. The door-in-door refrigerator of claim 1, wherein the trigger is configured to move in a substantially vertical direction.

3. The door-in-door refrigerator of claim 1, wherein the handle includes a first foot coupled to the outer door and a bar mounted to the outer door through the first foot, with the bar being configured to be gripped by a user's hand and the trigger being configured to move in a direction substantially parallel to the bar.

4. The door-in-door refrigerator of claim 3, wherein the handle further includes a second foot coupled to the outer door, the bar further mounted to the outer door through the second foot.

5. The door-in-door refrigerator of claim 4, wherein the trigger is located between the first foot and the second foot.

6. The door-in-door refrigerator of claim 3, wherein the trigger is located between the outer door and the bar.

7. The door-in-door refrigerator of claim 3, wherein:

the first foot includes an opening; and the trigger is configured to slide within the opening during movement of the trigger.

8. The door-in-door refrigerator of claim 1, wherein the latch further includes a latching bar and a catch, the latching bar being configured to selectively contact the catch, wherein, when the latching bar contacts the catch, the latch is latched, and, when the latching bar does not contact the catch, the latch is unlatched.

9. The door-in-door refrigerator of claim 8, wherein:

the trigger is coupled to the latching bar;

movement of the trigger causes the latching bar to move into or out of contact with the catch; and the latch further includes a spring configured to bias the latching bar into contact with the catch.

10. The door-in-door refrigerator of claim 9, wherein:

the latching bar is coupled to the outer door; and the catch is coupled to the inner door.

11. The door-in-door refrigerator of claim 1, wherein the trigger is configured to be directly acted upon by a user.

12. A method of coupling an inner door to and decoupling the inner door from an outer door of a door-in-door refrigerator, the door-in-door refrigerator including: a cabinet including a liner that defines a refrigerated compartment; a door configured to selectively seal the refrigerated compartment, the door including the inner door and the outer door; a storage structure coupled to the door, the storage structure being configured to store food items, wherein, when the inner and outer doors are in open positions, food items stored in the refrigerated compartment are accessible, when the inner and outer doors are in closed positions, the door extends across and seals the refrigerated compartment and food items stored in the refrigerated compartment are not accessible, and, when the inner door is in a closed position and the outer door is in an open position, food items stored in the storage structure are accessible; a handle coupled to the outer door; and a latch configured to selectively couple the inner door to the outer door, the latch including a trigger coupled to the outer door, said method comprising:

moving the trigger in a direction substantially parallel to the handle to shift the latch between a latched position, in which pulling on the handle causes the inner and outer doors to open, and an unlatched position, in which pulling on the handle causes the outer door to open while the inner door remains closed.

13. The method of claim 12, wherein moving the trigger includes moving the trigger in a substantially vertical direction.

14. The method of claim 12, wherein the handle includes a first foot coupled to the outer door and a bar mounted to the outer door through the first foot, with the bar being configured to be gripped by a user's hand, said method further comprising moving the trigger includes moving the trigger in a direction substantially parallel to the bar.

15. The method of claim 14, wherein the handle further includes a second foot coupled to the outer door, the bar is further mounted to the outer door through the second foot and the trigger is located between the first foot and the second foot, said method further comprising:

moving the trigger includes moving the trigger away from one of the first and second feet and toward the other of the first and second feet.

16. The method of claim 14, wherein moving the trigger includes moving the trigger in a space between the outer door and the bar.

17. The method of claim 14, wherein the first foot includes an opening, said method further comprising: moving the trigger includes sliding the trigger within the opening.

18. The method of claim 12, wherein the latch further includes a latching bar and a catch, the latching bar being configured to selectively contact the catch, and the trigger is coupled to the latching bar, said method further comprising: moving the trigger includes causing the latching bar to move into or out of contact with the catch.

19. The method of claim 18, wherein moving the trigger includes causing the latching bar to move out of contact with the catch and shifting the latch to the unlatched position, wherein the latch further includes a spring, the method further comprising biasing the latching bar into contact with the catch.

20. The method of claim 12, wherein the trigger is configured to be directly acted upon by a user.

* * * * *